United States Patent [19]

Takai

[11] 4,287,714

[45] Sep. 8, 1981

[54] FALSE-TWISTING SYSTEM

[75] Inventor: Isao Takai, Komatsu, Japan

[73] Assignee: Oda Gosen Kogyo Kabushiki Kaisha, Komatsu, Japan

[21] Appl. No.: 69,143

[22] Filed: Aug. 23, 1979

[30] Foreign Application Priority Data

| | | | |
|---|---|---|---|
| Aug. 31, 1978 | [JP] | Japan | 53-106900 |
| Aug. 31, 1978 | [JP] | Japan | 53-106901 |
| Aug. 31, 1978 | [JP] | Japan | 53-106902 |
| May 16, 1979 | [JP] | Japan | 54-59096 |
| May 16, 1979 | [JP] | Japan | 54-59097 |

[51] Int. Cl.[3] ..... D02G 3/38; D02G 1/04

[52] U.S. Cl. ..... 57/336; 57/210

[58] Field of Search ..... 57/200, 204, 206, 207, 57/208, 210, 211, 224, 225, 226, 227, 228, 243, 244, 245, 246, 247, 248, 6, 328, 908, 12, 336, 282, 284

[56] References Cited

U.S. PATENT DOCUMENTS

| | | | |
|---|---|---|---|
| 2,908,133 | 10/1959 | Brown | 57/336 |
| 3,070,950 | 1/1963 | Thomas | 57/12 X |
| 3,496,714 | 2/1970 | Schroeder | 57/207 X |
| 3,608,296 | 9/1971 | Taylor | 57/244 X |
| 3,685,268 | 8/1972 | Sequin | 57/11 |
| 3,729,918 | 5/1973 | Kawasaki et al. | 57/245 X |
| 3,780,515 | 12/1973 | Waters | 57/12 X |
| 4,047,373 | 9/1977 | Takai | 57/336 |
| 4,144,700 | 3/1979 | Takai et al. | 57/336 X |
| 4,196,574 | 4/1980 | Rhash | 57/207 X |

*Primary Examiner*—Donald Watkins

*Attorney, Agent, or Firm*—David G. Alexander

[57] ABSTRACT

A false-twisting system uses nipping type false-twisting apparatus designed to nip filament yarns between two intercrossing endless belts whose working surfaces are urged in the crossing region into engagement with each other.

Monofilaments of a first multifilament yarn are wound fast round monofilaments of a second multi-filament yarn with combined S- and Z-twists to provide a crimped bundle of yarn closely resembling spun yarns.

10 Claims, 17 Drawing Figures

FALSE-TWISTING SYSTEM

BACKGROUND OF THE INVENTION

The present invention relates to composite crimped bundles of filament yarns and a method of producing such bundles of filament yarns. More specifically, the present invention is concerned with composite crimped filament yarns resembling spun yarns in their external appearance and a method of preparing such filament yarns.

Various methods have heretofore been proposed for preparing filament yarns which closely resemble spun yarns by the use of long filaments. One method employs a widely used spindle type false-twisting apparatus to perform false-twisting of two filament yarns simultaneously. This method, however, involves a drawback in that the two filament yarns once coiled together in a position upstream of a spindle become separated again in another position downstream of the spindle due to a large magnitude of tension applied to the yarns in a de-twisting zone. The result is insufficient twining of monofilaments of one yarn round those of the other as shown in FIG. 17 of the accompanying drawings. Another shortcoming inherent in this type of method is that such a tension in the de-twisting zone adds to the liability of breakage of filament yarns and, hence, impairs the efficiency. Another method relies on a friction type internal or external contact false-twisting apparatus using belts or drums as well known in the art. This method is neither fully acceptable because the tension in the de-twisting zone is too high to insure firm entwinement of the monofilaments of the yarns as in the first-mentioned spindle type process.

SUMMARY OF THE INVENTION

An object of the present invention is to provide a composite crimped bundle of filament yarn having monofilaments of two filament yarns coiled fast round each other.

Another object of the present invention is to provide a composite crimped filament yarn which resembles spun yarns in external appearance.

A further object of the present invention is to provide a composite crimped filament yarn of unique appearance by using two filament yarns which are different from each other in the property and diameter of the monofilaments.

More specifically, the present invention provides a composite crimped filament yarn made up of two filament yarns each consisting of a plurality of monofilaments and in which the monofilaments of one yarn are twined fast round those of the other.

The present invention also provides a method of producing a composite crimped filament yarn having two filament yarns entangled tightly with each other. For this purpose, the present invention uses a false-twisting apparatus of a novel nipping type invented by the present inventor and disclosed in U.S. Pat. No. 4,047,373 in which two intercrossing endless belts have their working surfaces pressed against each other in the crossing area. The two filament yarns are passed together through the crossing area of the endless belts while the tension applied to the filament yarns on the downstream side of the false twister is preselected to be smaller than the tension exerted on the upstream side.

DESCRIPTION OF THE PREFERRED EMBODIMENTS

A method of producing composite crimped filament yarns will hereinafter be described with reference to FIGS. 1–3.

Figure 1:
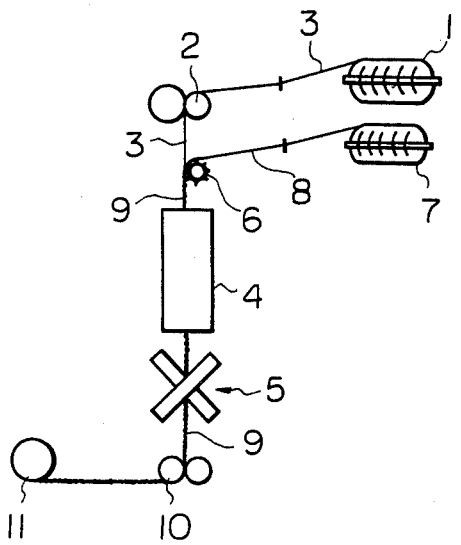
FIG. 1 is a schematic illustration of the overall arrangement of a system for producing a composite crimped filament yarn according to the present invention.

Referring to FIG. 1, a first multi-filament yarn 3 is wound around on a bobbin 1 and fed therefrom by a pair of feed rollers 2 to a nipping type false-twisting device 5 by way of a heating unit 4. A second multi-filament yarn 8 is fed from a bobbin 7 by the action of a feed roller 6 positioned downstream of the feed roller pair 2. Travelling past the feed roller 6, the second filament yarn 8 is so guided as to join the first filament yarn 3. Since that portion of the first filament yarn 3 downstream of the feed roller pair 2 is twisted, the second filament yarn 8 joining the first filament yarn 3 coils itself round the first filament yarn 3 to make up a composite filament bundle yarn 9. This composite bundle 9 advances to the false-twisting device 5 through the heating unit 4.

Figure 2:
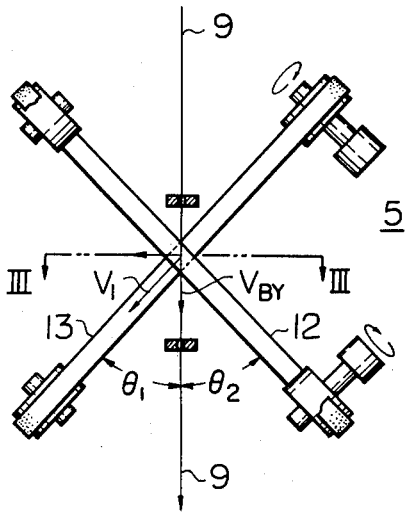
FIG. 2 is an elevation of a nipping type false-twisting apparatus applicable to the present invention.
Figure 3:
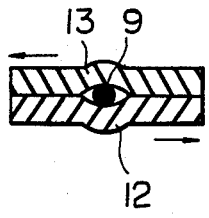
FIG. 3 is a section taken along line III—III of FIG. 2.

Details of the nipping type false twister 5 are illustrated in FIG. 2. The false twister 5 is comprised of two endless flat surfaced belts 12 and 13 crossing each other and, as viewed in FIG. 3, urged in the crossing area into contact with each other for nipping the composite filament yarn 9 therebetween. Travel of the belts 12 and 13 therefore will not only twist, but feed the composite filament yarn 9. More specifically, assuming that the surface velocity of the belts 12 and 13 is $V_1$ and the angle defined between each belt 12 or 13 and the filament yarn 9 is $\theta$, the belts 12 and 13 will impart the filament yarn 9 an advancing velocity $V_{BY}$ expressed as follows:

$$V_{BY} = V_1 \cos \theta$$

It will thus be seen that, thanks to the advancing action provided by the false twister 5 in addition to the twisting action, the composite filament yarn 9 can be drawn out of the false twister 5 without resort to a tension which is larger than a tension applied upstream of the false twister 5 which would otherwise be exerted on the filament yarn 9 downstream of the false twister 5. According to the present invention, a tension $T_2$ applied to the processed yarn 9 on the outlet or downstream side of the false twister 5 is preselected to be smaller in magnitude than a tension $T_1$ applied to the yarn 9 on the inlet or upstream side. These tensions $T_1$ and $T_2$ acting on the filament yarn 9 depend on the rotating velocities of the feed rollers 2 and 6, rotating velocity of a delivery roller pair 10 and the magnitude of the advancing velocity $V_{BY}$ imparted by the endless belts 12 and 13 as mentioned previously.

The composite filament yarn 9 passed through the false twister 5 and then the delivery roller pair 10 is reeled up on a take-up roller 11. Preferably, the feed roller 6 for the second filament yarn 8 is a twist-preventive roller. Various changes and modifications are possible in connection with the overall arrangement, such as provision of an additional heating unit downstream of the false twister 5.

As will be understood from examples described hereinafter, the method discussed above produces a uniquely fashioned composite filament yarn resembling spun yarns which has the second filament yarn coiled fast round the first or core yarn.

Figure 4:
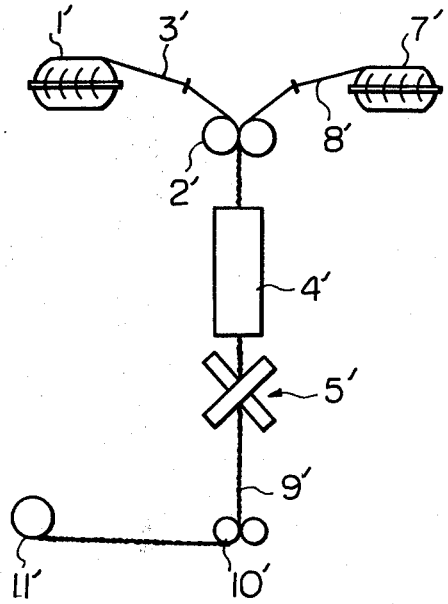
FIG. 4 schematically shows another system for producing a composite crimped filament yarn according to the present invention.

FIG. 4 illustrates another method according to the present invention in which first and second filament yarns are processed simultaneously for the production of a composite bundle of yarn.

Referring to FIG. 4, first and second multi-filament yarns 3' and 8' are drawn by a common feed roller pair 2' from bobbins 1' and 7', respectively. From the feed rollers 2', the filament yarns 3' and 8' advance, while entwining with each other, to a heating unit 4' and therefrom to a nipping type false-twisting device 5'. A processed composite filament yarn 9' from the false twister 5' further advances through a delivery roller pair 10' until it is wound round a take-up roller 11'. In the method of FIG. 4, the tension $T_2$ applied to the composite filament yarn 9' is again preselected to be smaller than the tension $T_1$ applied to the yarn 9' on the inlet or upstream side.

Such a method employing simultaneous feed of two filament yarns provides a composite bundle of yarns in which monofilaments constituting the respective filament yarns are intertwined tightly as will be presented in the examples hereinafter.

The present invention will further be described in conjunction with these examples.

EXAMPLE 1

A crimped composite bundle of two filament yarns was prepared according to the method shown in FIG. 1 under the conditions described below.

Figure 5:
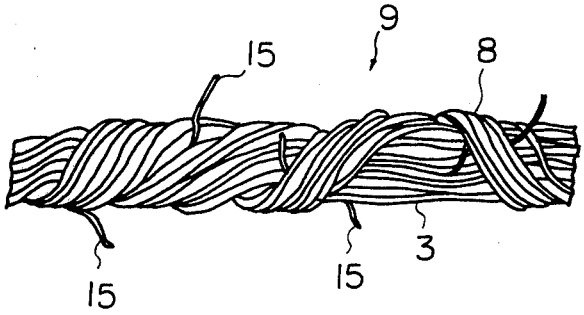
FIGS. 5 and 6 show in microphotographic elevation and section, respectively, a composite crimped filament yarn prepared by causing a multi-filament spun yarn to coil round a core consisting of a thermoplastic yarn of long monofilaments using the system shown in FIG. 1.
Figure 6:
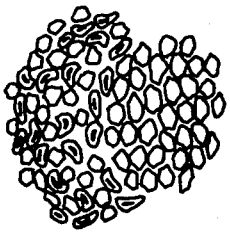

1st filament yarn (3): polyester SD 75 de/36 fil
2nd filament yarn (8): EC 42 de/1 fil (No. 43 count mixed yarn of 50% polyester and 50% cotton; nearly equal to 110 de)
Input tension $T_1$: 48–54 g
Output tension $T_2$: 8 g
Peripheral speed $V_F$ of feed roller (2): 362.7 m/min
Peripheral speed $V_W$ of take-up roller (11): 303.0 m/min
Belt feed speed $V_{BY}$: 264.3 m/min As presented microscopically in FIGS. 5 and 6, the processed composite yarn 9 is constituted by the polyester filament yarn 3 and the spun filament yarn 8 well twined round the filament yarn 3 with combined S- and Z-twists. Hair or fluff 15 of the filament yarn 8 projecting from the bundle 9 provide an external appearance very much resembling spun yarns. Where a hygroscopic spun yarn is used as the second filament yarn 8, the resultant composite bundle 9 also has a hygroscopic property.

EXAMPLE 2

The method of FIG. 1 was performed under the following conditions to obtain a composite crimped bundle of two filament yarns.

Figure 7:
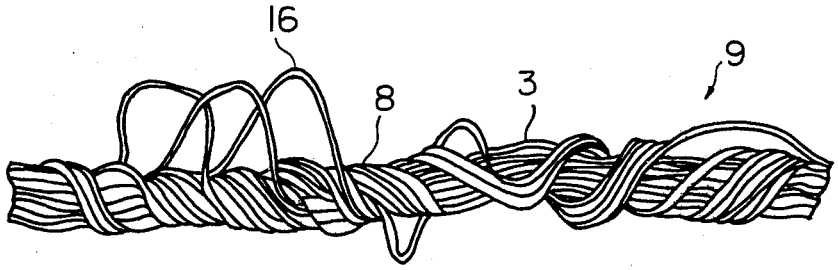
FIGS. 7 and 8 also show in microphotographic elevation and section, respectively, a composite crimped filament yarn having relatively fine monofilaments of one yarn twined round relatively thick monofilaments of the other yarn produced by the system of FIG. 1.
Figure 8:
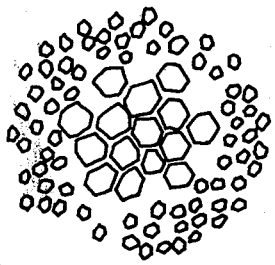

1st filament yarn (3): polyester SD 75 de/15 fil
2nd filament yarn (8): polyester SD 75 de/72 fil
Input tension $T_1$: 60 g
Output tension $T_2$: 4 g
Peripheral speed $V_F$ of feed roller (2): 380.5 m/min
Peripheral speed $V_W$ of take-up roller (11): 339.8 m/min
Belt feed speed $V_{BY}$: 382.9 m/min The processed composite bundle 9 as seen in FIGS. 7 and 8 has the second yarn 8 of relatively fine monofilaments well coiled round the first or core 3 of relatively thick monofilaments with S- and Z-twists in combination. Loops 16 were formed by the fine monofilaments of the yarn 8 projecting from the bundle 9 so that the bundle 9 has a unique fashion resembling that of spun yarns.

EXAMPLE 3

The method of FIG. 1 was performed under the following conditions.

Figure 9:
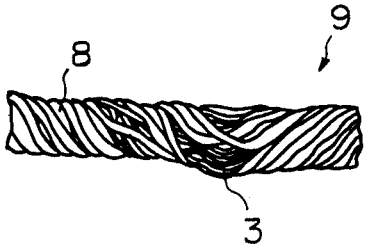
FIGS. 9 and 10 are a microphotographic elevation and a section, respectively, of a composite crimped filament yarn consisting of relatively thick monofilaments of one yarn twined round relatively fine monofilaments of the other yarn produced by the system of FIG. 1.
Figure 10:
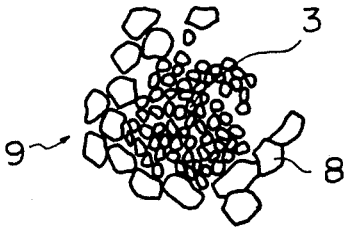

1st filament yarn (3): polyester SD 75 de/72 fil
2nd filament yarn (8): polyester SD 75 de/15 fil
Input tension $T_1$: 63 g
Output tension $T_2$: 4–5 g
Peripheral speed $V_F$ of feed roller (2): 388.9 m/min
Peripheral speed $V_W$ of take-up roller (11): 349.7 m/min
Belt feed speed $V_{BY}$: 382.3 m/min As viewed in FIGS. 9 and 10, the processed composite bundle 9 has the second yarn 8 of relatively thick monofilaments well coiled round the first or core 3 of relatively fine monofilaments with S- and Z-twists in combination. The bundle 9 has a unique external appearance bearing a close resemblance to that of spun yarns.

EXAMPLE 4

The method of FIG. 1 was performed under the following conditions.

Figure 11:
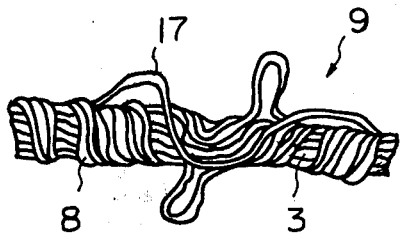
FIGS. 11 and 12 show in microphotographic elevation and section, respectively, a composite crimped filament yarn produced by the system of FIG. 1 using two yarns having monofilaments of common diameter in which one of the yarns is coiled round the other.
Figure 12:
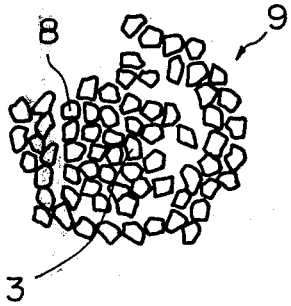

1st filament yarn (3): polyester SD 75 de/36 fil
2nd filament yarn (8): polyester SD 75 de/36 fil Input tension $T_1$: 60 g
Output tension $T_2$: 4–5 g
Peripheral speed $V_F$ of feed roller (2): 380.5 m/min
Peripheral speed $V_W$ of take-up roller (11): 339.8 m/min
Belt feed speed $V_{BY}$: 382.9 m/min The resultant bundle of filament yarns 9 is shown in FIGS. 11 and 12 and has the first yarn 3 serving as a core and the second yarn 8 well coiled round the core in combined S- and Z-twists. Loops 17 were formed by the monofilaments of the filament yarn 8 which protrude partially from the bundle 9. This configuration of filament yarns causes the bundle 9 to appear as if it were a spun yarn.

EXAMPLE 5

Figure 13:
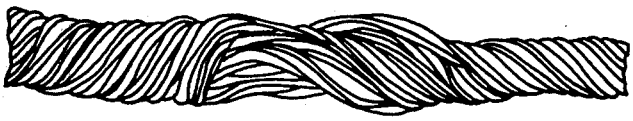
FIGS. 13 and 14 show a composite crimped filament yarn produced by the system of FIG. 4 in microphotographic elevation and section, respectively.
Figure 14:
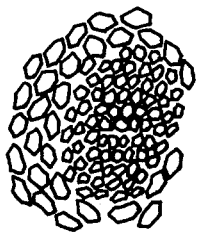

A crimped composite bundle of two filament yarns was prepared according to the method shown in FIG. 4 under the conditions indicated below.
1st filament yarn (3'): Tetoron (Terylene) BR 150 de/72 fil
2nd filament yarn (8'): Tetoron BR 150 de/30 fil
Input tension $T_1$: 105 g
Output tension $T_2$: 3 g
Peripheral speed of feed roller (2'): 388.9 m/min
Peripheral speed of take-up roller (11'): 349.7 m/min
Belt feed speed $V_{BY}$: 484.0 m/min As seen in FIGS. 13 and 14, the processed composite bundle 9' has a structure in which the monofilaments of the two filament yarns are twined fast around each other with S- and Z-twists mixed together. While in many cases one of the filament yarns making up the processed bundle 9' has both portions positioned inwardly and outwardly of the other, it sometimes happens that one only surrounded the other or core in the general structure of the processed bundle as was the case with the method of FIG. 1.

EXAMPLE 6

Figure 15:
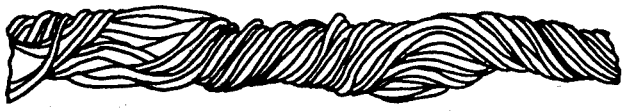
FIGS. 15 and 16 show another composite crimped filament yarn produced by the system of FIG. 4 in microphotographic elevation and section, respectively.
Figure 16:
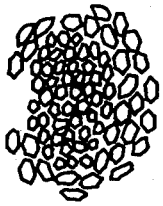

The method of FIG. 4 was performed under the following conditions.
1st filament yarn (3'): Tetoron BR 100 de/48 fil
2nd filament yarn (8'): Tetoron BR 150 de/30 fil
Input tension $T_1$: 115–120 g
Output tension $T_2$: 3 g
Peripheral speed of feed roller (2'): 388.9 m/min
Peripheral speed of take-up roller (11'): 349.7 m/min
Belt feed speed $V_{BY}$: 484.0 m/min The resultant composite bundle 9' was found to have a structure shown in FIGS. 15 and 16 in which monofilaments of the two filament yarns entwined fast around each other with S- and Z-twists appearing in combination.

COMPARATIVE EXAMPLE

Figure 17:
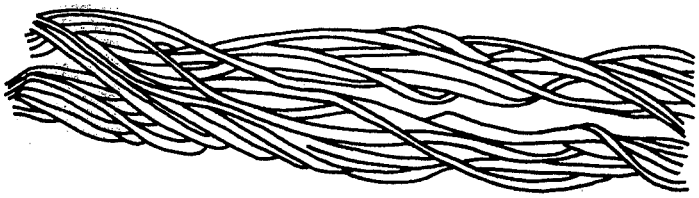
FIG. 17 is a microphotographic elevation of a composite crimped filament yarn produced by a conventional process using a spindle type system.

A false-twisting method of a conventional spindle type was used to prepare a crimped composite bundle of two filament yarns under the following conditions.
1st filament yarn: Nylon 50 de/17 fil
2nd filament yarn: polyester 135 de/30 fil
Input tension $T_1$: 15.5 g
Output tension $T_2$: 31.3 g The composite bundle provided by this method has the monofilaments of the yarns left separated and coiled poorly as represented by the microscopic view of FIG. 17.

It will now be appreciated from the foregoing that a false-twisting process according to the present invention produces a composite crimped filament yarn of a novel style made up of two filament yarns whose monofilaments are entwined fast round each other. Thanks to its inherent external appearance, the composite filament yarn is utilizable in various ways.

What is claimed is:

1. A composite crimped filament yarn, characterized by comprising first and second filament yarns each consisting of a plurality of monofilaments which are entangled firmly with monofilaments of the other of said yarns;

each of said filament yarns having S- and Z-twists in combination;

one of said filament yarns serving as a core while the other is twined round said core by a nipping type false twisting apparatus which causes said filament yarns to advance together therethrough in such a manner that said filament yarns are subjected to a greater tension at an inlet side of said false twisting apparatus than at an outlet side thereof.

2. A composite crimped filament yarn as claimed in claim 1, wherein one of said filament yarns functioning as a core is comprised of thermoplastic long monofilaments and the other is a spun yarn.

3. A composite crimped filament yarn as claimed in claim 1, wherein one of said filament yarns serving as a core is comprised of relatively thick thermoplastic long monofilaments while the other consists of relatively fine thermoplastic long monofilaments.

4. A composite crimped filament yarn as claimed in claim 3, wherein monofilaments of one of said filament yarns serving as a core is at least 4 deniers thick and monofilaments of the other are finer than 1.5 deniers.

5. A composite crimped filament yarn as claimed in claim 1, wherein one of said filament yarns serving as a core has monofilaments which are relatively fine thermoplastic long filaments while the other has monofilaments which are relatively broad thermoplastic filaments.

6. A composite crimped filament yarn as claimed in claim 5, wherein one of said filament yarns consists of monofilaments which are finer than 1.5 deniers, the other consisting of monofilaments which are at least 4 deniers thick.

7. A composite crimped filament yarn as claimed in claim 1, wherein the monofilaments of said first and second filament yarns are common in diameter to each other.

8. A method of producing a composite crimped filament yarn, characterized by preparing a nipping type false-twisting apparatus which comprises two intercrossing endless belts pressed against each other in a crossing area and movable in contact with each other, and causing two filament yarns each consisting of a plurality of monofilaments to advance together through side false-twisting apparatus while subjecting said filament yarns on an outlet side of said false-twisting device to a tension preselected to be smaller in magnitude than a tension applied to said filament yarns on an inlet side of said false-twisting apparatus.

9. A method as claimed in claim 8, comprising providing feed roller means associated with one of said two filament yarns positioned downstream of feed roller means for the other filament yarn, whereby said one filament yarn is caused to entwine the outer periphery of said other filament yarn.

10. A method as claimed in claim 8, comprising passing said two filament yarns to said false-twisting apparatus through common feed roller means.

* * * * *